United States Patent [19]

Christensen

[11] 4,425,738

[45] Jan. 17, 1984

[54] AUTOMATIC THRESHOLD SEAL FOR A DOOR

[76] Inventor: Curtis M. Christensen, R.R. 2, Box 71, Slayton, Murray County, Minn. 56172

[21] Appl. No.: 444,282

[22] Filed: Nov. 24, 1982

[51] Int. Cl.[3] ..... E06B 7/20

[52] U.S. Cl. ..... 49/310; 49/308

[58] Field of Search ..... 49/310, 306, 307, 308, 49/303, 311

[56] References Cited

U.S. PATENT DOCUMENTS

| | | | |
|---|---|---|---|
| 93,487 | 8/1869 | Shaw . | |
| 105,615 | 7/1870 | Whitmore et al. . | |
| 247,786 | 10/1881 | Tapper . | |
| 308,735 | 12/1884 | Bell . | |
| 649,150 | 5/1900 | Winter . | |
| 1,054,158 | 2/1913 | Wickstrum . | |
| 1,426,737 | 8/1922 | Hines et al. . | |
| 1,646,559 | 10/1927 | Ray et al. . | |
| 1,651,570 | 12/1927 | Woodcock . | |
| 1,688,577 | 10/1928 | Dupen . | |
| 1,729,902 | 10/1929 | Smith | 49/310 |
| 1,948,108 | 2/1934 | Goellner . | |
| 1,976,970 | 10/1934 | Spanjers et al. . | |
| 1,994,645 | 3/1935 | Hazzard . | |
| 2,206,183 | 7/1940 | Goodfellow . | |
| 2,282,019 | 5/1942 | Balousek . | |
| 2,344,278 | 3/1944 | Balousek . | |
| 2,548,716 | 4/1951 | Funk | 49/310 |
| 3,281,990 | 11/1966 | Nilsson | 49/306 |
| 3,418,753 | 12/1968 | Hanson | 49/308 |
| 3,871,133 | 3/1975 | Elingson, Jr. | 49/308 |
| 4,170,846 | 10/1979 | Dumenk et al. | 49/303 |

*Primary Examiner*—Philip C. Kannan

*Attorney, Agent, or Firm*—Henderson & Sturm

[57] ABSTRACT

An automatic threshold seal for a door having a pivoted structure for bearing a compressible seal disposed within a housing and comprising apertured control members affixed within said housing and to the upper surface of said pivoting structure through which a spring rod is installed in such fashion that the apertured control member affixed to said pivoting structure automatically operates the seal as an end of the spring rod projecting through the hinged edge of the housing is activated as the door opens and shuts.

5 Claims, 5 Drawing Figures

AUTOMATIC THRESHOLD SEAL FOR A DOOR

TECHNICAL FIELD

The present invention relates generally to door bottom weather sealing mechanisms and more particularly to a mechanism which automatically rises above anticipated obstructions when the door is swung open.

BACKGROUND ART

Automatic door bottom sealing mechanisms are well known in the art and generally are activated by a spring biased rod or cam action link which engages the hinge jamb of a doorway when the door is shut, causing a seal to drop onto or pivot against the threshold and to move above anticipated obstructions as the door is swung open. Due to the constant presence of dust, dirt, and moisture in and around such mechanisms, it is desirable to have an automatic threshold seal comprising as few moving parts as possible, said parts having a minimum of surface areas in rubbing contact with each other.

In addition, such prior art mechanisms employing cam action parts may perform satisfactorily under ideal conditions, but tend to bend and go out of adjustment when the threshold engaging structure is forced to move against solid, foreign objects which it might inadvertently encounter.

DISCLOSURE OF THE INVENTION

An object of the present invention is the provision of an improved automatic threshold seal for a door.

Another object is to provide an automatic threshold seal which has relatively few parts which are subject to disfunction as a result of accumulations of dirt, grime and moisture.

A further object of the invention is the provision of an automatic threshold seal which has relatively few parts in frictional contact with each other.

Still another object is to provide an automatic threshold seal whose parts which are in frictional contact, contact each other along relatively small surfaces.

A still further object of the invention is to provide an automatic threshold seal which has no cam action parts.

Yet another object is the provision of an automatic threshold seal which has parts not readily subject to bending or going out of adjustment.

Yet a further object is to provide an automatic threshold seal which can readily withstand the shock of stones, broom handles or other such foreign objects in the path of the door as it is closing.

An additional object of the invention is the provision of an automatic threshold seal which is economical to manufacture, assemble and maintain.

In a more general sense, it is an object of this invention to provide an automatic threshold seal comprising a door foreshortened at its bottom and having an elongated open-bottomed housing affixed thereto, a threshold engaging structure having a compressible seal running its length, pivotally mounted within the housing such that it may pivot between a position contacting the threshold of the door and a recessed position within the housing, and a spring rod interconnecting the housing interior and the pivotal threshold-engaging structure through apertured control members affixed to either one in a manner whereby the closing of the door will force the spring rod inwardly as the door contacts the hinged door jamb, thereby causing the threshold-engaging structure to seal against the threshold as the door shuts and to return to its recessed position as the door opens.

These and other objects, advantages, and novel features of the present invention will become apparent from the following detailed discription of the invention when considered in conjunction with the accompanying drawings.

BEST MODE FOR CARRYING OUT THE INVENTION

Figures 1, 4, 5:
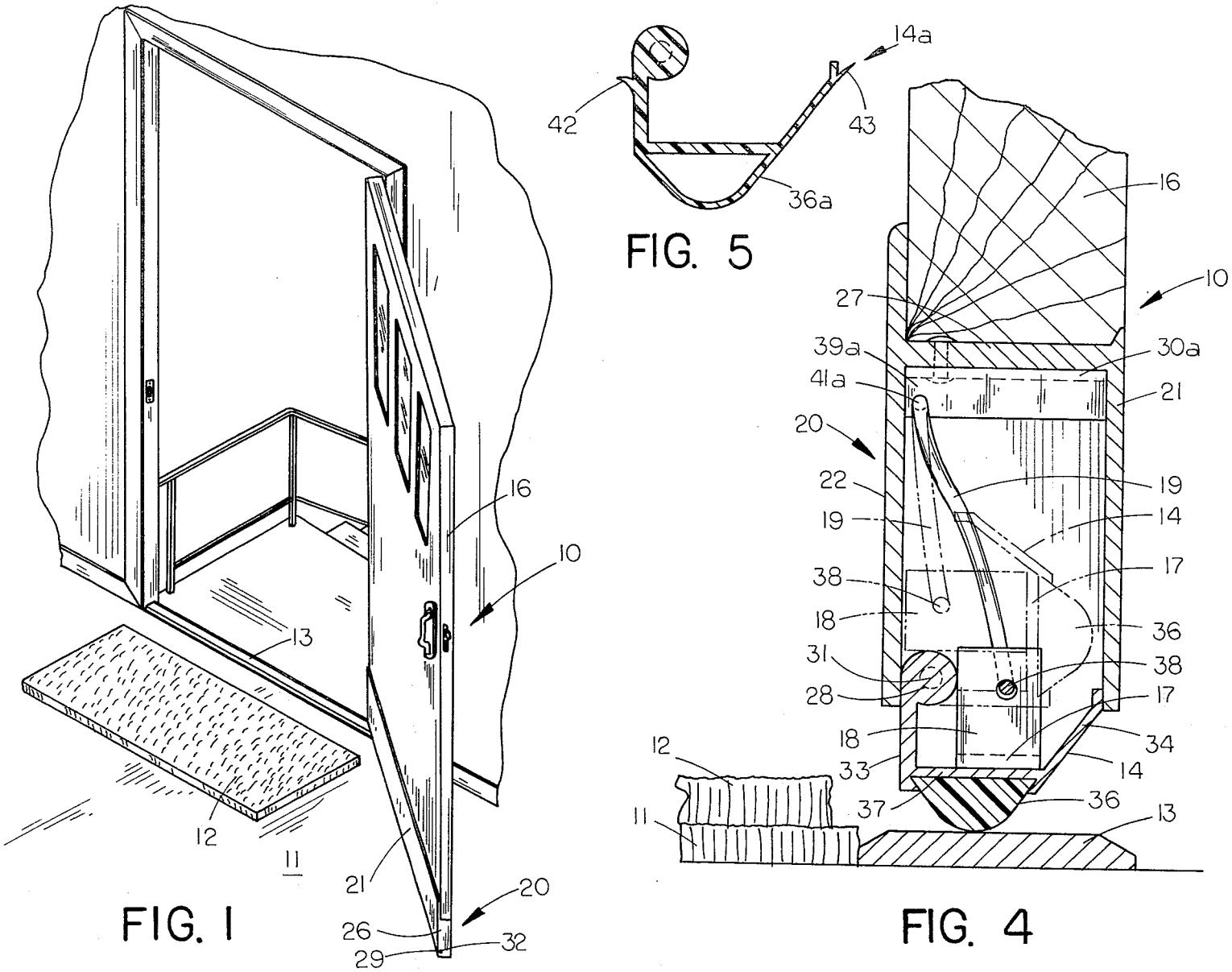
FIG. 1 is a perspective view of a door equipped with my automatic threshold seal showing the door swung open.
FIG. 4 is a supra-enlarged cross-sectional view along lines 4—4 of FIGS. 2 and 3 showing the threshold engaging structure pivoted downwardly in solid lines and pivoted upwardly in phantom lines.
FIG. 5 is a supra-enlarged sectional view showing an alternate threshold-engaging structure.

Referring now to the drawings wherein like reference numerals designate identical or corresponding parts throughout the several views, and more particular to FIG. 1 whereon a door equipped with the automatic threshold seal of this invention and designated generally at (10), is shown opening inwardly into a building. Also depicted in FIG. 1 and better seen in FIG. 4 are typical obstructions to the inward swing of a door, carpeting (11) and mat (12). Referring again to FIG. 4 it can be appreciated that a typical threshold (13) is somewhat below the level of the top of mat (12) and that, under ideal conditions outside weather would be sealed against entering the building between threshold (13) and the bottom of the door when the door is closed. Likewise, ideally the bottom of the door would be above the top of mat (12) soon after it begins its swing open. Therefore, two levels for the bottom of a door are provided by pivotally mounted threshold-engaging structure (14), one when structure (14) is pivoted downwardly as depicted by solid lines in FIG. 4 and the other when threshold-engaging structure (14) is pivoted upwardly as seen by phanton lines in FIG. 4.

Figure 2:
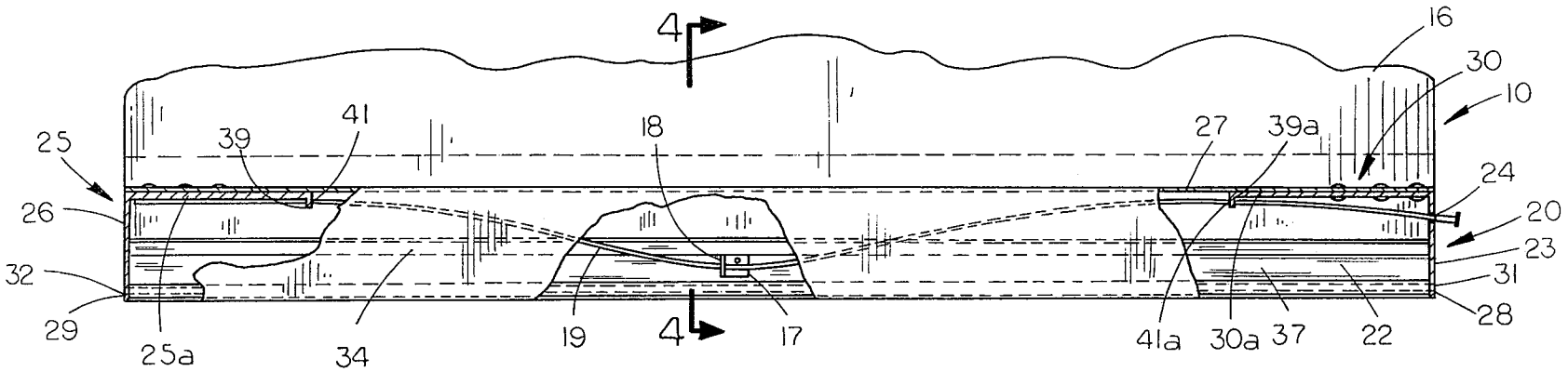
FIG. 2 is an enlarged partial front elevational view, with parts broken away, of the present invention showing it in the swung open attitude.
Figure 3:
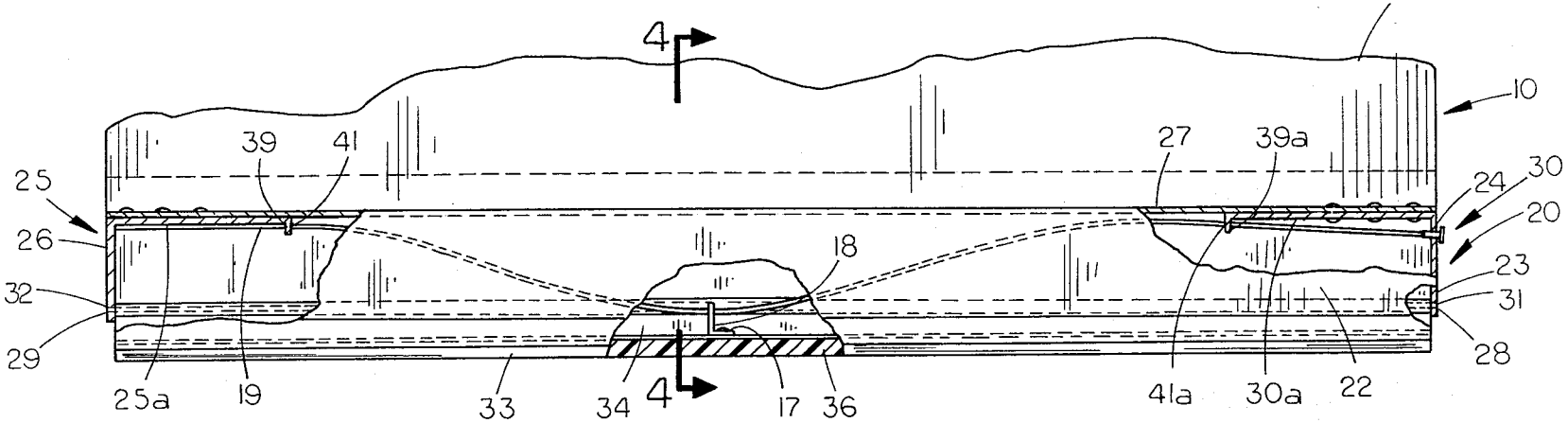
FIG. 3 is a partial front elevational view, with parts broken away, of the present invention showing it in the swung shut attitude.

Referring once more to FIG. 1, automatic threshold seal for a door (10) is seen to be further comprised of foreshortened door (16) and elongated housing assembly (20). Housing assembly (20) is affixed to the bottom of door (16) at a level sufficient to allow clearance for obstructions in its swing path. Referring now to FIGS. 2 and 3 (see also FIG. 4), threshold seal (10) is yet further seen as comprised of L-shaped member (17) and spring rod (19). When threshold-engaging member (14) is pivoted downwardly, member (18) of L-shaped support (17) projects upwardly.

Housing (20) is essentially a rectangular box enclosed on all sides except its bottom, and having a horizontal cross-section substantially equivalent to that of door (16). It is essential that at least one of its two vertical walls, which extend the width of the door opening, be solid so as to complete the separation of the environments on either side of door (16). In this embodiment, exterior vertical wall (21) serves as the weather wall, the other width-wise vertical wall (22) of housing (20) assisting in that function as well as sealing the interior of housing (20) from dust and debris. Both width-wise walls would generally be considered essential as regards overall appearance.

Housing (20) also includes a cap wall (27) which serves primarily to strengthen housing (20) and to provide a surface for mounting to the bottom of door (16) an outside end assembly (25) adjacent to the unhinged edge of door (16), and hinge side end assembly (30) adjacent to the hinged edge of door (16). End assenmbly (25) is comprised of an endwall (26), a horizontal portion (25) and a downwardly projecting member (39), whose function will be hereinafter explained. End assembly (30) is likewise comprised of an endwall (23), a horizontal portion (30*a*) and a downwardly projecting member (39*a*). Horizontal portions (25*a*) and (30*a*) are mounted to the underside of cap wall (27) in a conventional manner.

Endwall (23) has an aperture (24) (see FIGS. 2 and 3) therethrough which is located in its upper portion intermediate walls (21) and (22). Both endwalls (23) and (26) haver circular opposing apertures (28) and (29), respectively, located therein near the bottom of housing assembly (20) and adjacent to vertical width-wise wall (22) thereof. Apertures (28) and (29) serve as bearings for opposing projecting pins (31) and (32) of threshold-engaging structure (14), thus permitting its pivotal movement thereabout.

In cross-section threshold-engaging structure (14) is irregularly U-shaped and pins (31) and (32) are located at the upper end of the left vertical leg (33) thereof as viewed in FIG. 4. The right leg (34) of the U-shaped cross-section of threshold-engaging structure (14) slopes outwardly and rubber-like compressible sealing strip (36) is carried along the bottom of structure (14) in a position offset towards leg (33), such that when threshold-engaging structure (14) is pivoted upwardly, leg (34) moves away from the plane of weather wall (21) and sealing strip (36) clears the inside thereof as it moves upwardly and to a position within housing (20).

L-shaped support (17), which is affixed intermediate the ends of threshold-engaging structure (14) to the horizontal portion thereof when it is pivoted downwardly, is at an orientation whereby planar member (18) will then be projecting upwardly and be oriented perpendicularly to the length thereof. Planar member (18) further has aperture (38) running through it, aperture (38) being lower than aperture (24) of endwall (23) regardless of the pivotal position of structure (14). As can be seen in FIG. 4, when threshold-engaging structure (14) pivots upwardly, apertured member (18) moves upwardly and to the left (as seen in phantom lines), planar member (18) being of such a length that it will fit within housing assembly (20) when leg (33) of threshold-engaging structure (14) has reached a substantially horizontal orientation. As will be explained hereinbelow, apertured member (18) serves to control the pivotal movement of threshold-engaging structure (14).

The two downwardly projecting members (39) and (39*a*)(see FIGS. 2, 3, and 4) are located near the inside of width-wise wall (22) such that apertures (41) and (41*a*) in each member (39) and (39*a*), respectively, are at all times above aperture (38) of upwardly projecting apertured member (18) and somewhat aligned with aperture (24) of endwall (23). Members (39) and (39*a*) are located on either side of upwardly projecting apertured member (18) such that they serve to assist member (18) in controlling the pivotal movement of threshold-engaging structure (14).

The installation of spring rod (19) and how it serves to maintain sealing strip (36) in contact with threshold (13) when door (16) is shut and move it into its elevated position as door (16) begins its swing open will now be described. As can best be seen in FIGS. 2 and 3, spring rod (19) is installed within housing (20) by running it first through aperture (24) of end wall (23), then through aperture (41*a*) of the adjacent downwardly projecting member (39*a*), then through aperture (38) of upwardly projecting member (18), then through aperture (41) of the other downwardly projecting member (39) and then continuing until it is finally stopped by the inside wall of end wall (26). A short portion of spring rod (19) extends beyond end wall (23) when threshold-engaging member (14) is pivoted upwardly (see FIG. 2), and substantially no portion of spring rod (19) extends beyond end wall (23) when threshold-engaging member (14) is pivoted downwardly (see FIG. 3).

When door (16) is swung open, spring rod (19) attempts to straighten out, thereby pulling upwardly and inwardly (with respect to carpet (11) and mat (12) on apertured member (18) and causing threshold-engaging member (14) to pivot upwardly within housing (20). When door (16) is closed, spring rod (19) is forced substantially entirely inside of housing (20) by the door jamb which is adjacent to endwall (23), causing spring (19) to bow and force apertured member (18) downwardly and away from carpet (11) and mat (12), thus returning it to its downward position in contact with threshold (13).

While apertured members (39) and (39*a*) are theoretically not essential to the operation of door seal (10), the use of either one or both of these members will assist in controlling the proper position of spring rod (19) within housing (20) and causing threshold-engaging member (14) to react quicker and more certainly to its movements within housing (20). Cap (42) on the end of spring rod (19) adjacent end wall (23) serves to reduce the possibility of damage to the door jamb and to dampen the initial movements of spring rod (19) within housing (20).

Referring to FIG. 5, whereon a modified threshold engaging structure is depicted generally at (14*a*), said structure (14*a*) and its sealing strip (36*a*) can be made entirely of vinyl in a single duotherm extrusion process. This process ordinarily results in a considerable savings and effectively produces the required rigidity and flexibility in the structure (14*a*) and seal (36*a*), respectively. The interior of automatic threshold seal (10) is additionally and effectively sealed from the environment by flexible projections (42) and (43).

INDUSTRIAL APPLICABILITY

The industrial applicability of the automatic threshold seal for a door is believed to be manifest from the foregoing description. Doors equipped with the present invention will seal tight against a threshold when they are closed and will move above obstructions such as carpeting and floor mats without hindrance shortly after being swung open.

Accordingly, it is believed that all of the objects mentioned above are accomplished by use of the best mode for carrying out the invention disclosed herein. Obviously, many modifications and variations of the present invention are possible in light of the above teachings. It is therefore to be understood that, within the scope of the appended claims, the invention may be practised otherwise than as specifically described.

I claim:

1. An automatic threshold seal for a door, comprising:

a door foreshortened at its bottom;

an elongated housing having an open bottom affixed to the bottom of said door, said housing of a vertical depth such that when affixed its bottom will be above the threshold a sufficient distance to allow clearance above anticipated obstructions within its swing path, said housing including:

a rectangular vertical weather wall extending the width of said door;

a first endwall adjacent to the hinged edge of said door and having an aperture therethrough; and a second endwall adjacent to the unhinged edge of said door;

means pivotally mounted at a lower level than the aperture through the first endwall, to each of the lower portions of and intermediate the first and second endwalls of said housing for engaging the threshold area between the jambs of said door;

a apertured member affixed to said threshold-engaging means intermediate the ends thereof and oriented towards the open bottom of said housing said aperture therethrough axially parallel with the pivotal axis of said threshold-engaging means and offset horizontally in the same direction from both the pivotal axis of said threshold-engaging means and the hole through the first endwall;

a spring rod, spring loaded within said housing through the aperture through the first endwall thereof, then through said apertured member, and then to a means for stopping its further travel, the length of said rod being such that when it is loaded and said door is somewhat open, a portion thereof will extend past the first endwall of said housing.

2. The automatic threshold seal of claim 1 further comprising:

a second apertured member mounted inside said housing somewhat away laterally from said first apertured member, said aperture thereof being axially parallel and somewhat aligned with the aperture through the first endwall and wherein said spring rod is also spring loaded through the second apertured member.

3. The automatic threshold seal of claim 2, further comprising:

a third apertured member mounted inside said housing somewhat away laterally from said first apertured member on the other side thereof from said second apertured member, said aperture thereof being axially parallel and somewhat aligned with the aperture through the first endwall and wherein said spring rod is also spring loaded through the third apertured member.

4. The automatic threshold seal of claims 1, 2 or 3 wherein the weather wall is co-planar with one side of said door and said housing further includes a second rectangular vertical wall extending the width of said door and co-planar with the other side of said door.

5. The automatic threshold seal of claim 4 wherein the inside plane of said second endwall serves as the stopping means.

* * * * *